United States Patent [19]

Abbey

[11] 4,250,856

[45] Feb. 17, 1981

[54] FUEL-AIR RATIO AUTOMATIC CONTROL SYSTEM USING VARIABLE VENTURI STRUCTURE

[76] Inventor: Harold G. Abbey, 11 Goldsmith Dr., Holmdel, N.J. 07733

[21] Appl. No.: 115,551

[22] Filed: Jan. 25, 1980

Related U.S. Application Data

[63] Continuation-in-part of Ser. No. 962,883, Nov. 22, 1978, Pat. No. 4,187,805, which is a continuation-in-part of Ser. No. 919,541, Jun. 27, 1978.

[51] Int. Cl.[3] ..... F02M 7/12

[52] U.S. Cl. ..... 123/439; 123/440; 261/DIG. 56; 261/DIG. 64; 261/44 D; 261/69 R; 261/121 A; 261/79 R; 261/DIG. 74; 261/78 R; 261/DIG. 39; 261/DIG. 67; 261/64 A; 261/36 A

[58] Field of Search ..... 123/119 EC, 439, 440; 261/DIG. 56, DIG. 61, DIG. 62, DIG. 63, DIG. 64, 44 D, 69 R, 121 A, 79 R, DIG. 74, 78 R, DIG. 39, DIG. 67, 64 A, 36 A

[56] References Cited

U.S. PATENT DOCUMENTS

| | | | |
|---|---|---|---|
| 1,153,436 | 9/1915 | McCray | 261/DIG. 61 |
| 1,386,036 | 8/1921 | Weeks | 261/DIG. 64 |
| 1,394,536 | 10/1921 | Chase | 261/DIG. 64 |
| 1,465,449 | 8/1923 | Maegly | 261/DIG. 61 |
| 1,983,225 | 12/1934 | Wahlmark | 261/DIG. 56 |
| 2,066,544 | 1/1937 | Shaw | 261/DIG. 56 |
| 3,659,572 | 5/1972 | Pelizzoni | 261/DIG. 56 |
| 3,778,038 | 12/1973 | Eversole et al. | 261/DIG. 56 |
| 3,778,041 | 12/1973 | Kincade | 261/DIG. 56 |
| 3,817,227 | 6/1974 | Priegel | 261/DIG. 74 |
| 3,960,118 | 6/1976 | Konomi et al. | 123/32 EE |
| 4,052,968 | 10/1977 | Hattori et al. | 123/32 EE |
| 4,084,562 | 4/1978 | Eckert | 123/119 EC |
| 4,111,169 | 9/1978 | Lawrence | 261/DIG. 74 |
| 4,118,444 | 10/1978 | Abbey | 261/DIG. 56 |

FOREIGN PATENT DOCUMENTS

| | | | |
|---|---|---|---|
| 2014140 | 10/1970 | Fed. Rep. of Germany | 261/DIG. 56 |
| 2219880 | 10/1973 | Fed. Rep. of Germany | 261/DIG. 56 |

*Primary Examiner*—Tim R. Miles
*Attorney, Agent, or Firm*—Michael Ebert

[57] ABSTRACT

An automatic control system for supplying a fuel-air mixture to an internal combustion engine through a Venturi structure conducting throttle-controlled incoming air to the intake manifold of the engine. Coaxially disposed in the casing of the structure is a cylindrical booster whose internal surface has a Venturi configuration to define a primary passage. Interposed between the booster and a ring having an external Venturi configuration mounted on the casing in an axially shiftable spool whose internal surface has a Venturi configuration to define a secondary passage having a variable throat between this surface and the spool. A tertiary passage is defined between the outer surface of the spool and the ring, incoming air passing through all three passages. An air-fuel dispersion is fed into the primary passage to intermingle with air flowing therethrough to create an atomized mixture which is fed through the variable throat of the secondary passage to further atomize the mixture which is then fed into the manifold. The air pressure difference between the inlet to the Venturi and the effective throat of the combined passages is sensed to produce a command signal for governing a servo motor in a closed loop arrangement to adjust the axial position of the spool to attain an optimum fuel-air ratio.

17 Claims, 9 Drawing Figures

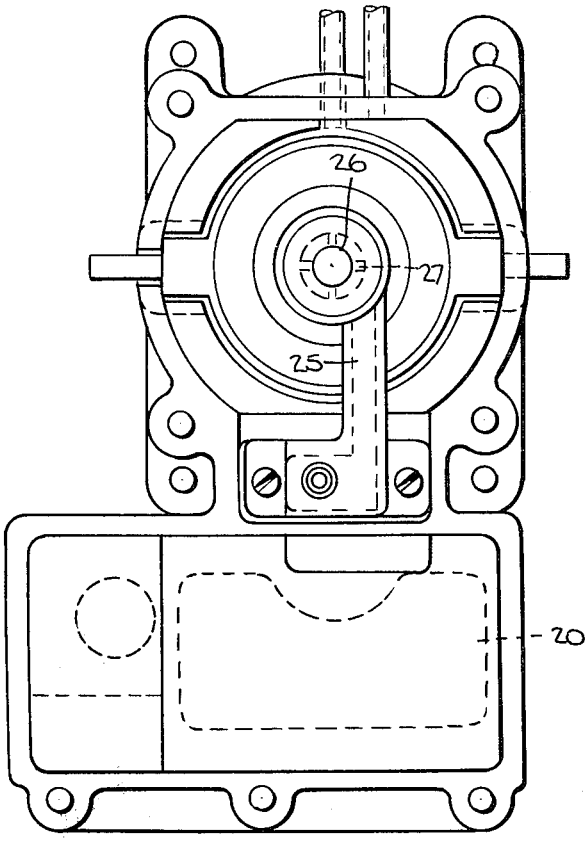
Fig. 3.
Fig. 4.
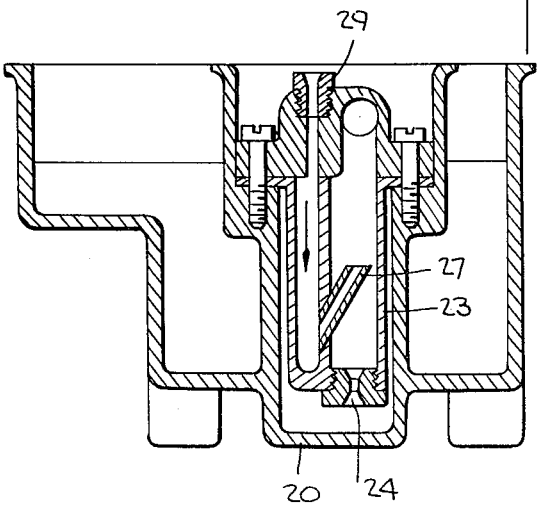

Atmospheric Or Supercharged Air Supply
Throttle
Electronic Fuel Control
Control Module
Aux Inputs
EO Sensor
Exhaust Manifold
To Servo Motor
FB
Vacuum Accumulator
AVT
MVT
VA
Engine Intake Manifold
Fuel Tank
34
43
36
44
32
P1
P2
P3
10
11
13
15A
17
22
26A
37
38
39
40
41
42
45

FUEL-AIR RATIO AUTOMATIC CONTROL SYSTEM USING VARIABLE VENTURI STRUCTURE

RELATED APPLICATIONS

This application is a continuation-in-part of a pending application Ser. No. 962,883, filed Nov. 22, 1978, now U.S. Pat. No. 4,187,805 which in turn is a continuation-in-part of a pending application Ser. No. 919,541, filed June 27, 1978.

BACKGROUND OF INVENTION

This invention relates generally to variable Venturi carburetion systems for supplying a fuel-air mixture to the internal combustion engine of an automotive vehicle, and more particularly to an improved system for automatically controlling the flow of fuel and air admitted into a variable Venturi structure to maintain a desired ratio thereof under varying conditions of load and speed in order to attain higher combustion efficiency, reduced emissions and significantly increased fuel economy.

The function of a carburetor is to produce the fuel-air mixture needed for the operation of an internal combustion engine. In the carburetor, the fuel is introduced in the form of tiny droplets in a stream of air, the droplets being vaporized as a result of heat absorption in a reduced pressure zone on the way to the combustion chamber whereby the mixture is rendered inflammable.

In a conventional carburetor, air flows into the carburetor through a Venturi tube which is generally circular in shape. The reduction in pressure at the Venturi throat causes fuel to flow from a float chamber in which the fuel is stored through a fuel jet into the air stream, the fuel being atomized because of the difference between air and fuel velocities. This "carburetion" effect is, however, operative only within a narrow range of engine speeds as predetermined by design selections which at best represent a compromise of all operating conditions in a motor vehicle.

The behavior of an internal combustion engine in terms of operating efficiency, fuel economy and emission of pollutants is directly affected by the fuel-air ratio of the combustible charge. Under ideal circumstances, the engine should at all times burn 14.7 parts of air to one part of fuel to satisfy the stoichiometric air-to-fuel ratio. But in actual operation, this ratio varies as a function of operating speed and is affected by changes in load and temperature.

To obtain maximum economy, the fuel-to-air ratio in the mixture should be maintained within close tolerances at the prescribed optimum air-fuel ratio for each mode of operation, such as "idle" while standing still, "slow-speeds" up to about 20 miles an hour, "cruising speeds" and "high speeds." The conventional practice is to provide an accelerating pump system to furnish an extra charge of fuel for accelerations, a choke system to enrich the mixture for starting a cold engine and a throttle by-pass jet for idle and slow speed, as well as a power jet or auxiliary barrels for high speed or high power operation, all in addition to the main jet.

Another reason why the maintenance of predetermined fuel-air ratios within prescribed limits is important is that the emission of pollutants as well as the power-producing efficiency are in large measure governed thereby. Thus, when the mixture is relatively low in air, carbon monoxide is produced, and when the ratio is excessively rich in fuel, unburned hydrocarbons are emitted in the exhaust. In modern engine design, the air-fuel ratio is in some instances controlled to maintain a prescribed ratio, or the control system is preprogrammed to accommodate the ratio to specific ranges of speed and load, so that the ratio, for example, is richer at slow speeds and leaner at higher speeds.

A major problem encountered in carburetion is to secure the correct amount of suction around the main jet at slow engine speeds and yet allow enough air to enter at high engine speeds to maintain the desired ratio of air and fuel. Vanturi size must, of necessity, represent a compromise for both high and low speed operation. Because the maximum power an engine can develop is limited by the amount of air it can breathe in, the Venturi size and shape should offer minimum resistance to the larger volume of air flowing at high engine speed. On the other hand, a small Venturi is desirable at low engine speeds to afford sufficient air velocity for controllable fuel metering and good fuel atomization.

The modern approach to this problem is the use of two or more Venturis arranged in series and/or two or more barrels in parallel. The multiple Venturi design serves two purposes: First, the added Venturis build up air velocity in the smaller primary Venturi, thereby augmenting the force available at the main nozzle for drawing and atomizing fuel. Second, air by-passing the primary Venturi forms an air cushion around the rich mixture discharged by the Venturi, tending to improve mixture distribution by preventing fuel from engaging the carburetor walls. Idle or very slow speed is invariably served by an auxiliary jet around the edge of the throttle plate.

However, the typical modern carburetor requires a series of additional jets and pumping systems that cut in and out as the carburetor velocity increases and decreases above and below average speed; and as the engine operation passes through successive operating modes of acceleration, cruising, high speed and deceleration. Idle or very slow speed operations both rely on an idle jet arrangement at the closed position of the butterfly throttle valve. The actions of these primary devices give rise to large fluctuations in the air-fuel ratio and thereby adversely affect fuel economy and emissions.

But fuel economy is not the only reason for maintaining steady air-to-fuel ratios; for, as pointed out in *Business Week* (June 21, 1976), though a new catalytic converter is available which is adapted to limit the emission of hydrocarbons, carbon monoxide and nitrogen oxides, "A steady ratio (air-to-fuel) is crucial to the new converter because it must simultaneously harbor conflicting chemical reactions." As noted in this article, "in actual operation, the ratio fluctuates with acceleration and deceleration."

Although fuel-air mixtures may be introduced to the combustion chambers of an engine by means other than carburetors, as by fuel injection, supercharging and other expedients, none of these is comparable in effectiveness with the Venturi principle for efficient atomization of volatile fuels.

Attempts have heretofore been made to provide variable-Venturi carburetors to tailor the air-fuel supply to changing engine conditions. Thus U.S. Pat. No. 2,066,544; 3,659,572 and 3,778,041 show various embodiments of a variable-Venturi carburetor.

In my above-identified copending application Ser. No. 962,883, filed Nov. 22, 1978, whose entire disclosure is incorporated herein by reference, there is disclosed an automatic system which includes a variable-Venturi carburetor for intermingling air and fuel and for feeding the air-fuel mixture in an appropriate ratio into the throttle inlet of the manifold. Air is fed into the output of the Venturi, the air passing through the throat thereof whose effective area is adjusted by a mechanism operated by a servo motor. Fuel is fed into the input of the Venturi from a fuel reservoir through a main path having a fixed orifice and an auxiliary path formed by a metering valve operated by an auxiliary fuel-control motor. The differential air pressure developed between the inlet of the Venturi and the throat thereof is sensed to produce an air-velocity command signal which is applied to a controller adapted to compare this signal with the set point of the servo motor to produce an output for governing the servo motor to cause it to seek a null point, thereby defining a closed process control loop.

The intake manifold vacuum which varies in degree as a function of load and speed conditions is sensed to govern the auxiliary fuel-control motor accordingly and is, at the same time, converted into an auxiliary signal which is applied to the controller in the closed loop to modulate the command signal in a manner maintaining an optimum air-fuel ratio under the varying conditions of load and speed.

Thus the flow of air through the Venturi structure is controlled as a function of throat air velocity by a closed process control loop whose air velocity command signal is modulated by an auxiliary signal reflecting the degree of intake manifold vacuum developed under the prevailing conditions of speed and load. In this way, the flow of air and fuel in the carburetor are correlated to cope with the transitions through the modes of operation smoothly and without hesitation within prescribed desirable ratios.

The present invention deals with improvements in the system disclosed in my copending application. While this system seeks to take into account all conditions of load and speed actually experienced in a running internal combustion engine in order to maintain a fuel-to-air ratio that is optimized for the prevailing condition, the system has certain practical drawbacks which are overcome by the present invention.

These drawbacks are not necessarily unique to the system disclosed in my copending application. For example, in a conventional carburetor as well as in the variable Venturi structure of the type disclosed in my copending application, liquid fuel drawn from a reservoir is fed in by induction, the liquid fuel intermingling with and being atomized by the incoming combustion air stream. The atomized fuel is then vaporized to facilitate combustion. In order to avoid the emission of unburned hydrocarbon products and attain high combustion efficiency, the incoming fuel should be fully atomized and vaporized in the carburetor or Venturi structure. But because of the brief atomization period, atomization of the fuel is not fully effected and optimum combustion efficiency is not realized.

The following U.S. references are pertinent to the present invention: Pelizzoni, U.S. Pat. No. 3,659,572; Kincade, U.S. Pat. No. 3,778,041; Konomi et al., U.S. Pat. No. 3,960,118; Eckert, U.S. Pat. No. 4,084,562; Hattori et al., U.S. Pat. No. 4,052,968; Eversole et al., U.S. Pat. No. 3,778,038; Abbey U.S. Pat. No. 4,118,444; Priegel, U.S. Pat. No. 3,817,227; Lawrence, U.S. Pat. No. 4,111,169; and Wahlmark, U.S. Pat. No. 1,983,225. Also of interest is the German Pat. No. 2,014,140 to Marolla.

SUMMARY OF INVENTION

In view of the foregoing, the main object of this invention is to provide an automatically-controlled system for an internal combustion engine which maintains that ratio of air-to-fuel which represents the optimum ratio for the prevailing conditions of load and speed to effect a marked improvement in fuel economy and to substantially reduce the emission of noxious pollutants.

More particularly, it is an object of this invention to provide a system of the above type which includes a variable-Venturi structure to which air and fuel are supplied, the flow of air being controlled by a closed process control loop having a controller responsive to a command signal that is modulated as a function of load and speed conditions, and further modified by ambient and exhaust feedback sensors to correct or adjust air-fuel ratios to prevailing conditions in real-time.

A significant feature of the invention is that the fuel, before being admitted into the primary passage of the Venturi is dispersed in air to promote the vaporization thereof.

Another object of the invention is to provide a control system in conjunction with a Venturi structure which is responsive to air flow, the air being derived from an air pressure supply which includes conventional air boosters as well as atmospheric pressure upon demand without altering any of the control parameters. In an arrangement in accordance with the invention, both in the case of induction fuel feed or pressure fuel feed, the air throttle or valve may be placed upstream of the variable Venturi structure.

Yet another object of the invention is to provide an automatic control system which maintains an optimum ratio of fuel and air, which system operates efficiently and reliably and yet lends itself to low-cost mass-production.

Briefly stated, an automatic control system in accordance with the invention includes a variable-Venturi structure for intermingling air and fuel and for feeding the air-fuel mixture in an appropriate ratio into the intake manifold of the engine.

The variable Venturi structure is constituted by a cylindrical casing and a cylindrical booster coaxially disposed therein whose internal surface has a Venturi configuration to define a constant primary passage. Interposed between the booster and a ring mounted on the casing wall having an external Venturi configuration is an axially-shiftable spool whose internal surface has a Venturi configuration to define between this surface and said spool a variable secondary passage whose throat size depends on the axial position of the spool, a constant tertiary passage being defined between the outer surface of the spool and the ring surface.

Air passing through the casing flows through all three passages, an air-fuel dispersion being fed by a nozzle into the primary passage to intermingle with the air flowing therethrough to form an atomized mixture which is fed into the second passage to intermingle with the air flowing through the throat thereof, from which secondary passage the mixture is fed into the intake manifold.

The differential air pressure developed between the inlet of the Venturi structure and the throat of the tertiary passage therein is sensed to produce an air-velocity command signal which is applied to a control module that governs a servo motor operatively coupled to the spool to axially shift the spool and thereby adjust the throat of the secondary passage. The intake manifold vacuum which varies as a function of load and speed conditions is sensed to produce an auxiliary signal for modulating the command signal in the control module in a manner maintaining an optimum air-fuel ratio under the varying conditions of load and speed.

The air velocity command sensor and the intake manifold vacuum sensor are provided with operating characteristics that are predetermined for an engine of specified size and its load. Thus the signals from the sensors are "pre-programmed" for the response desired to the operating modes of the engine.

The control module, in essence, is an analog computer that not only responds to the command and speed-load signals to effect on-line control of the air-fuel ratio as preprogrammed, but it also accepts auxiliary signals for presetting and adjusting the control to take into account ambient and load conditions. These auxiliary signals are derived from ambient and exhaust sensors which afford continuous control of these variables in real-time.

Thus the flow of air through the Venturi structure is controlled as a function of air velocity by a closed process control loop whose air velocity command signal is modulated by an auxiliary signal reflecting the degree of intake manifold vacuum developed under the prevailing conditions of speed and load. In this way, the flow of air and fuel in the structure are correlated to cope with transitions through the various modes of vehicle operation smoothly and without hestitation within the prescribed desirable ratios, the emission of pollutants being held at a low level regardless of the mode of operation.

OUTLINE OF DRAWINGS

For a better understanding of the invention as well as other objects and further features thereof, reference is made to the following detailed description to be read in conjunction with the accompanying drawings, wherein:

FIG. 3 is a top view of the Venturi structure showing the relationship of the nozzle thereto;

FIG. 4 is a side view of the Venturi structure showing the air tube and fuel tube arrangement for dispersing the fuel;

FIG. 6 is a top view of the second embodiment;

Figure 8:
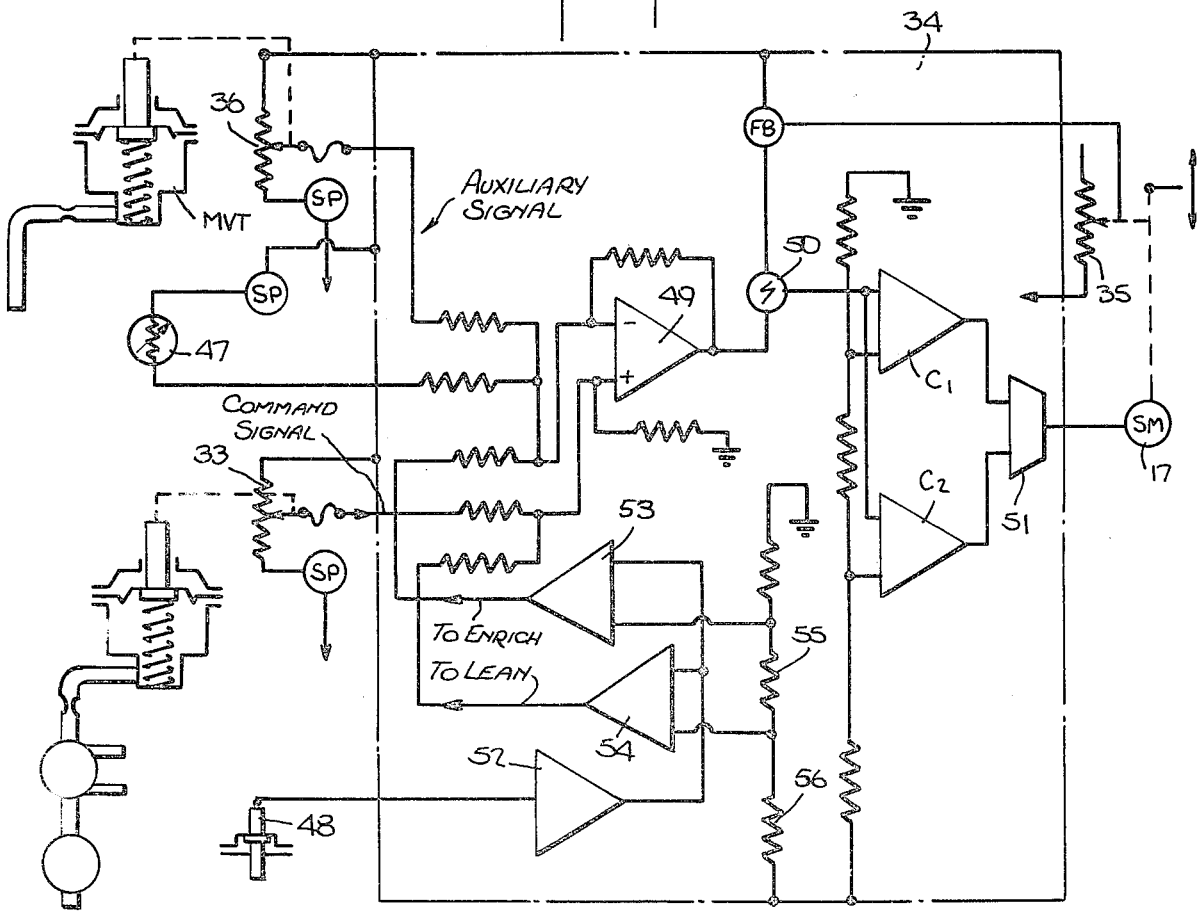

FIG. 8 schematically illustrates a third embodiment.

DESCRIPTION OF INVENTION

General Introduction

In an automobile powered by an internal combustion engine, the engine speed, the air valve of throttle position and the intake manifold pressure are the determinants for the operating conditions of the engine when it is warm. These characteristic determinants are interrelated, the fuel requirements of the engine being governed by the instantaneous state thereof. In order, therefore, to optimize the combustion efficiency of the engine, the present invention provides a self-regulating, closed-loop control of the air-fuel ratio in real time which is so rapidly responsive to changes in engine speed and load that transitions are smooth and bumpless.

By combustion efficiency is meant power economy expressed in miles per gallon and complete combustion of the available fuel to minimize the emission of unburned hydrocarbons and carbon monoxide. For purposes of combustion efficiency, besides accurate proportion of the air-fuel ratio to satisfy existing engine conditions, in the air and fuel must be thoroughly intermingled atomized and vaporized to a gas-like consistency. Failure to accomplish this objective results in incomplete completion of carbon monoxide and hydrocarbons which, as a consequence, are exhausted from the engine with an attendant loss of their inherent energy.

In a closed loop automatic control system in accordance with the invention, control of the air-fuel ratio is effected in a multi-passage variable-Venturi structure operating in conjunction with a control system in an arrangement in which the fuel is either induced into the Venturi primary passage or is fed therein by pressure. The term "pressure feed" is used rather than conventional fuel injection; for in the present invention, carburetion and injection take place concurrently, so that the pressure feed arrangement represents a hybrid of induction and injection.

In a system in accordance with the invention, whether of the inductive or pressure feed type, before being admitted into the Venturi the fuel is first dispersed by means of an air tube which induces air into the fuel being fed into the primary passage, the mixture being rendered turbulent and further mixing with combustion air in the secondary passage in a low-pressure environment to vaporize the fuel in air, the secondary passage having a variable throat.

In a system in accordance with the invention, the differential pressure $P_1-P_2$ developed between the air inlet to the Venturi structure and the throat of the tertiary passage is sensed and transduced to produce an air-velocity command signal that is applied to a mechanical-fluidic or electronic controller that also receives a signal representative of the intake manifold pressure ($P_3$). The controller on the basis of these signals governs the operation of a servo motor in a closed loop, the motor acting to adjust the Venturi throat in the secondary passage to provide an air-fuel ratio appropriate to the prevailing conditions as governed by an exhaust gas sensor's superimposed control.

In the inductive feed arrangement, the differential value $P_1-P_2$ is the controlling force which determines the volume of fuel-dispersion entering the air stream via a nozzle feeding the primary passage of the Venturi structure. In the pressure feed arrangement, the differential value is amplified and applied to a pressure regulator that controls the pressurized feed of the fuel dispersion into the Venturi primary passage.

It is to be noted that while the differential $P_1-P_2$ signal can be modified or modulated by other variables to provide the appropriate fuel-air ratio for all steady-state conditions, modulation of the $P_1-P_2$ signal in the controller by an auxiliary signal representing intake manifold pressure affords the instantaneous acceleration of the fuel-dispersion flow to the engine when accelerating or hill holding accompanied by a momentary enrichment which is limited by the exhaust gas sensor's corrective action through the electronic control. The signal from this sensor acts in reverse when decelerating, cruising or idling. In all changes of conditions initiated by the throttle manipulation by the operator of the vehicle, the interaction of auxiliary signals and the overall monitoring control effected by the exhaust sensor brings about smooth, bumpless performance and optimum fuel efficiency.

It will be evident from the foregoing that the ability of the control system to carry out the desired function depends on the responsiveness and accuracy of the system. While one can use a fluidic-mechanical or pneumatic control system for this purpose, advantages are gained by using an analog electronic signal processor and comparator module in accordance with the invention for operating an electrically controlled vacuum servo motor. This module is responsive to the air flow input and engine speed load signals as well as to auxiliary inputs representing engine emission and other sensed variables, so that the servo motor is governed as a function of all variables encountered in an engine which affect engine performance.

The term "Venturi Structure", as used herein, refers to a structure invented by Venturi to measure the flow of fluids and gases by means of a tube whose inlet or entry section converges toward a constricted throat section which in turn leads to a diverging outlet section, all sections having a circular cross section. In the present invention, an upstream tap in the Venturi structure makes available the input static pressure ($P_1$), while a tap at the throat provides a static pressure ($P_2$), which is less than that at the upstream tap, such that the differential pressure ($P_1-P_2$) is a function of the velocity of air passing through the structure.

In order to obtain an accurate indication of air flow velocity, it is important in the variable Venturi that the circular cross section thereof be maintained at all adjusted positions of the structure.

In a multi-Venturi structure of the type disclosed herein, the main throat thereof refers to that cross section area of the air-flow passages in the combined Venturis that is either the smallest or through which the air flow velocity is greatest, or conversely in which the static pressure is lowest. In the present invention in which there are primary, secondary and tertiary passages in the Venturi structure, the main throat is in line with the throat of the tertiary throat.

First Embodiment

Figure 1:
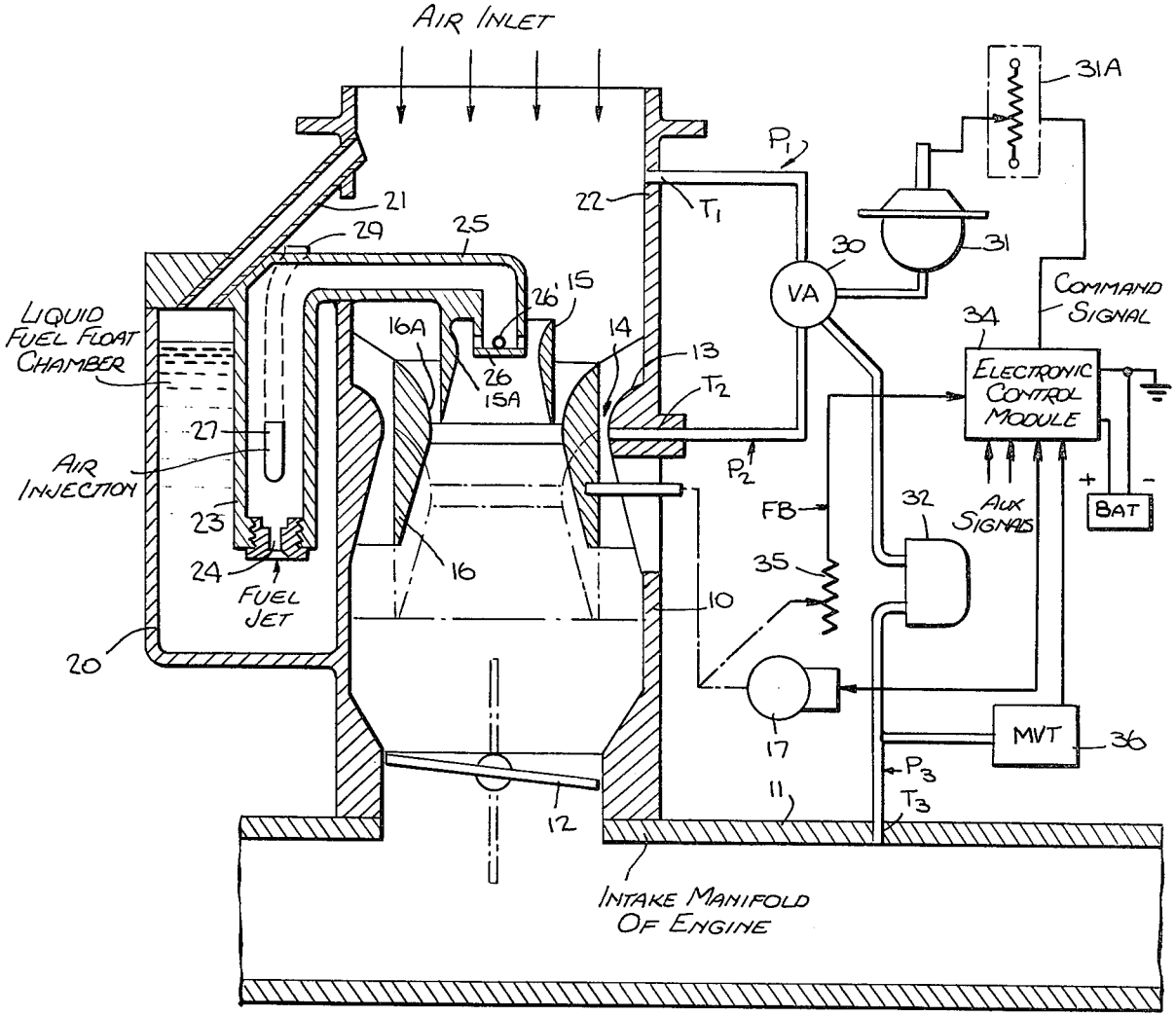
FIG. 1 shows a first embodiment of an automatic control system in accordance with the invention, using induction fuel feed in conjunction with a three-passage variable Venturi structure.

While a system in accordance with the invention is operable with any of the variable-Venturi structures disclosed in my above-identified copending patent applications, use is preferably made of a three-stage variable-Venturi structure of the type shown in FIG. 1 having a tubular casing 10 into which an air stream at atmospheric pressure is introduced. The lower end of casing 10 is coupled to the intake manifold 11 of the internal combustion engine through a foot-operated throttle inlet 12. Throttle 12 may be placed at the inlet of the Venturi structure rather than at the outlet as shown in FIG. 1. Thus in FIG. 1A, the throttle is placed at the inlet in an inductive feed arrangement, and in FIG. 5 the inlet throttle acts in a fuel pressure feed arrangement.

Disposed in the mid-section of casing 10 is a stationary ring 13 having an external Venturi configuration which defines a Venturi throat 14. Mounted coaxially within casing 10 is a cylindrical booster 15 having an internal Venturi configuration to define a primary passage 15A. The Venturi structure is completed by an axially-shifted cylindrical spool 16 interposed between booster 15 and ring 13 whose outer surface is a true cylinder and whose inner surface forms with the outer surface of booster 15 a secondary Venturi passage 16A whose inlet has a parabolic formation leading to a constricted throat. While the inlet section or entry of spool 16 may have a straight tapered information, the value of a parabolic surface lies in the linear change in cross-sectional area that occurs with linear axial movement of spool 16 as it is manipulated by a servo motor 17.

The exterior surface of spool 16, while having a uniform cylindrical form defines an annular tertiary Venturi passage 14 is conjunction with casing ring 13 which has a constant cross section in all axial positions of spool 16 to provide an ideal air metering means. Thus while the size of throat 14 is constant, the interior shape and position of spool 16 determines the air velocity vs. cross-sectional area characteristics of the multiple Venturis defined by the exterior surface of spool 16, Venturi ring 13, the interior surface of spool 16 and the exterior surface of booster 15, and the interior surface of booster 15 and the exterior of fuel nozzle 26. In practice, instead of a straight exterior surface, spool 16 may be tapered to provide a rising characteristic. Alternatively, the total cross sectional area of the through air passages constituting the "main" throat for any position of spool 16 consists of annular space 14 plus annular space 16A and annular space 15A.

Figure 2:
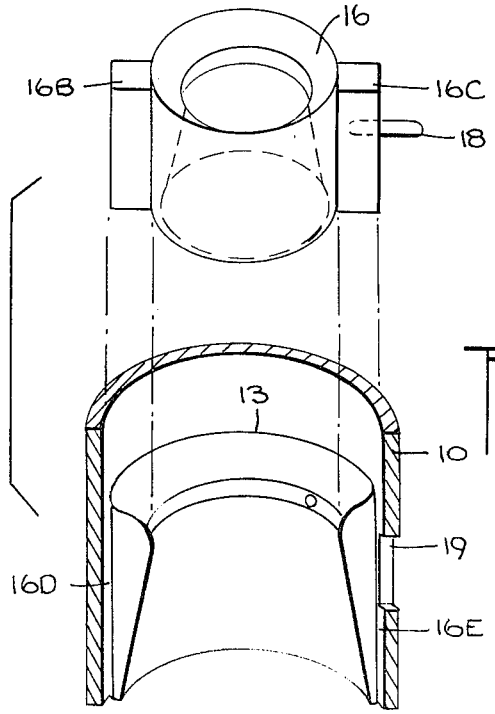
FIG. 2 illustrates, in perspective, a portion of the shiftable spool in the three-passage Venturi structure and the casing containing the Venturi ring.

To improve the volumetric efficiency of the Venturi structure by avoiding linkage mechanisms for the spool which project into the flow passage, the outer surface of spool 16, as best seen in FIG. 2, is provided at diametrically-opposed positions with a pair of ribs 16B and 16C which are slidably received in complementary slots 16D and 16E formed in Venturi ring 13. Rib 16C is provided with a pin 18 which projects through a slot 19 in casing 10, pin 18 being operatively coupled to servo motor 17 so that spool 16 may be axially raised or lowered within the limits defined by slot 19. Pin 18 is deliberately made smaller in cross section that the width of the rib from which it extends to effect hermetic sealing of the casing slot.

Adjacent casing 10 is a liquid fuel float chamber or reservoir 20, the upper end of which is vented through a duct 21 leading to the air inlet 22 of the Venturi structure. Fuel is drawn by induction from chamber 20 through a vertical tube 23 having a fuel jet orifice 24 at its lower end, the upper end of tube 23 communicating through a lateral duct 25 with a nozzle 26 which is supported by the duct coaxially within booster 15 of the Venturi structure. Nozzle 26 is provided with a circular series of jet openings 26' which serves to spray the fuel in radial streams into the booster.

It will be seen in FIG. 3 that duct 25 is positioned relative to nozzle 26 so as to feed fuel tangentially thereon to create a cyclonic flow or vortex of fuel within the nozzle producing a high degree of streamlined dispersion and longer contact time before joining the secondary air stream, thereby promoting atomization and vaporization of the fuel in the air intermingled therewith.

Figure 1A:
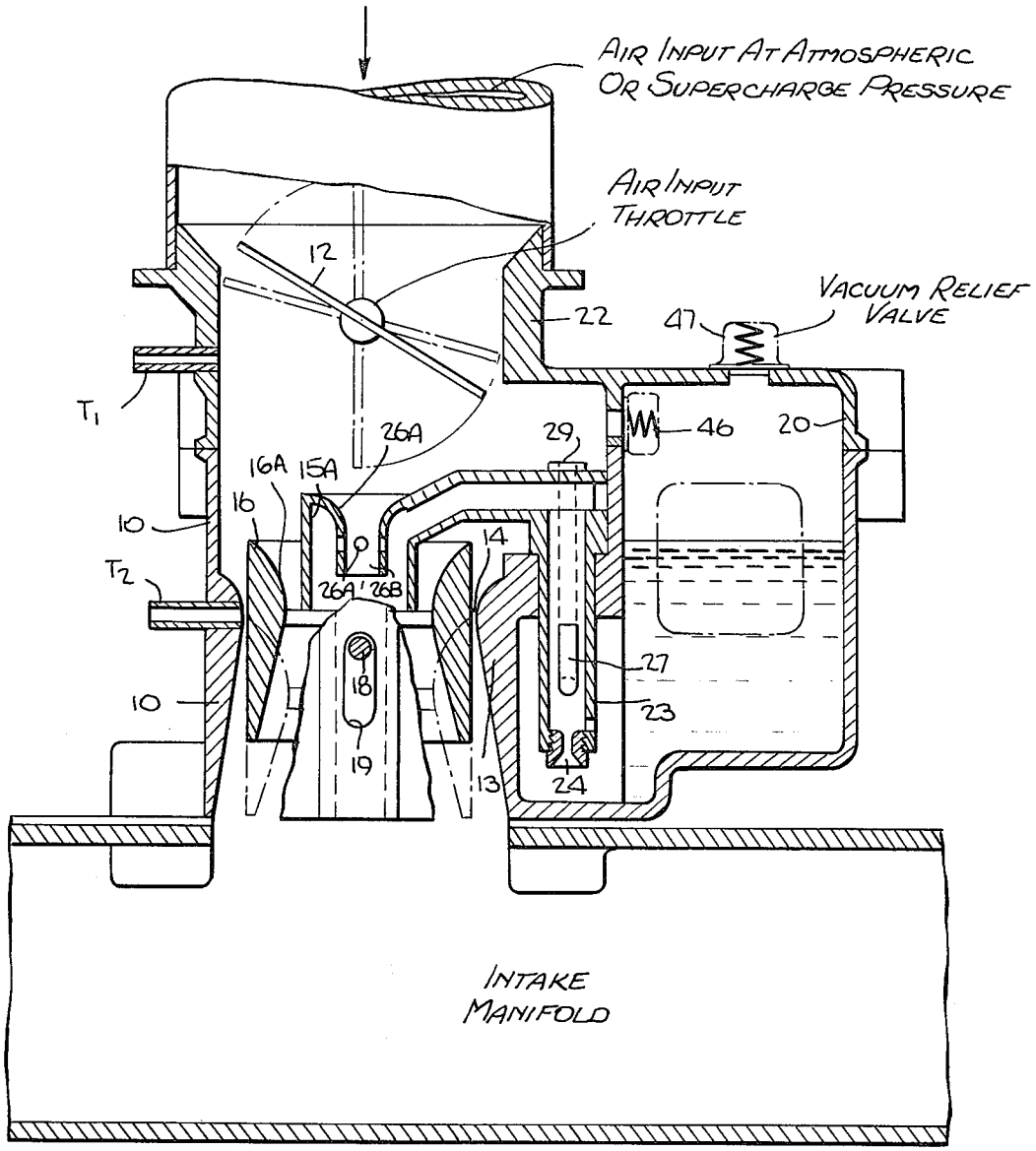
FIG. 1A shows a modified form of nozzle for the Venturi structure; and a modified fuel reservoir arrangement for pressure air supply with an input throttle location.
Figure 1B:
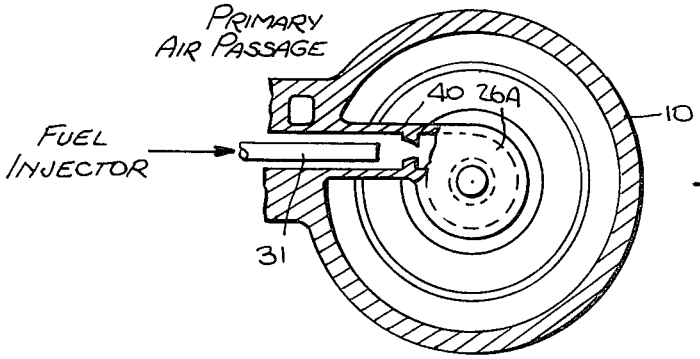

Air for dispersing the fuel is introduced into fuel tube 23 by way of an air induction tube 27, as shown in FIGS. 1, 1A and 4, whose inlet is angled upwardly in the fuel tube below the lowest fuel level. Inlet 29 of the air tube communicates with the air inlet 22 of the Venturi structure. Because fuel from nozzle 26 is projected into the primary passage defined by the interior of spool 15 which has a Venturi formation, the incoming air stream passing through the primary creates vacuum forces which draw air from the air inlet into air tube 27 and injects this air into fuel tube 23. Thus unlike conventional carburetors in which liquid fuel is introduced into the system to be intermingled with and atomized by combustion air, in the present invention, air is injected into the fuel before the fuel is fed into the carburetor. The injected air brings about a liquid fuel dispersion which promotes vaporization and reduces the fuel density, which in turn facilitates control of fuel "lag." The air/fuel dispersion is proportioned and maintained by the fixed orifices of fuel and air tubes, the quantity of dispersion induced into the primary passage being proportional to the prevailing pressure differential of air input pressure ($P_1$) less Venturi throat pressure ($P_2$).

Essential to a control system in accordance with the present invention are three pressure variables; namely, the pressure $P_1$ picked up at tap $T_1$ communicating with the air inlet to the Venturi structure; pressure $P_2$ picked up by a tap $T_2$ leading to the throat 14 in the tertiary Venturi passage; and pressure $P_3$ picked up by a tap $T_3$ communicating with the intake manifold of the engine.

Coupled to sensing taps $T_1$ and $T_2$ is a vacuum amplifier 30 responsive to the difference between pressures $P_1$ and $P_2$, which difference depends on the air velocity through the throat of the tertiary passage. Also applied to amplifier 30 is a vacuum signal proportional to the intake manifold pressure $P_3$, tap $T_3$ being coupled through a vacuum accumulator 32. The prevailing pressure differential $P_1$-$P_2$ developed between taps $T_1$ and $T_2$ is amplified and applied to an air velocity sensor in the form of a fluidic motor 31 which drives a potentiometer 31A constituting a transducer. The transducer produces an electrical command signal proportional to the velocity of air through throat 14. It is to be noted that the velocity of air through throat 14 into the tertiary passage is the velocity of the total of air and fuel at any condition of the secondary Venturi as set by the axial position of spool 16.

The command signal from transducer 33 is applied to an electronic module 34 whose output governs the operation of servo motor 17 which acts to axially shift spool 16 in the Venturi structure, thereby defining a closed process control loop in which the major process variable is the velocity of of air passing through throat 14 in the tertiary passage.

The closed loop serves to adjust the size of the throat in the secondary passage 16A defined by booster 15 and the Venturi-shaped interior of spool 16 to thereby vary the air velocity through the Venturi structure until a point is reached where the ratio of the induced fuel dispersion to the combustion air satisfies engine requirements as feedback to electronic module 34 by the various sensors. Servo motor 17 also positions a feedback transducer 35 whose output is applied to module 34 to indicate the existing position of the motor and to null with the prevailing command signal as modified by other engine conditions and output sensors.

Since the air velocity command signal applied to module 34 is modulated by an auxiliary signal produced by a transducer 36 whose output depends on intake manifold pressure, the operation of the loop takes into account prevailing conditions of speed and load. As pointed out in the application of which the present case is a C-I-P, the air velocity command signal may be further modulated or modified by control signals taken from sensors responsive to oxygen content in the exhaust, to the engine temperature and other operating variables.

Modification

In the modification of the Venturi structure shown in FIG. 1A, instead of a closed nozzle 26, as shown in FIG. 1, seated within the entry of booster 15A is a bell-mouthed nozzle 26A having openings 26A' around its throat and an open discharge outlet 26B. The downstream end of booster 15 is open at the throat line of the main Venturi throat 14.

In this arrangement, a check valve 46 is provided in a wall opening in fuel chamber 20 that extends between the air inlet region to the Venturi structure whose pressure is $P_1$ and the air space in the fuel chamber above the fuel level therein. In addition, a vacuum relief valve 47 is positioned on top chamber 20 in a wall opening extending between the air space above the fuel line and the atmosphere. In this way the surface of the fuel in the chamber is only subjected to atmospheric pressure or boosted atmospheric pressure only.

Second Embodiment

Figure 5:
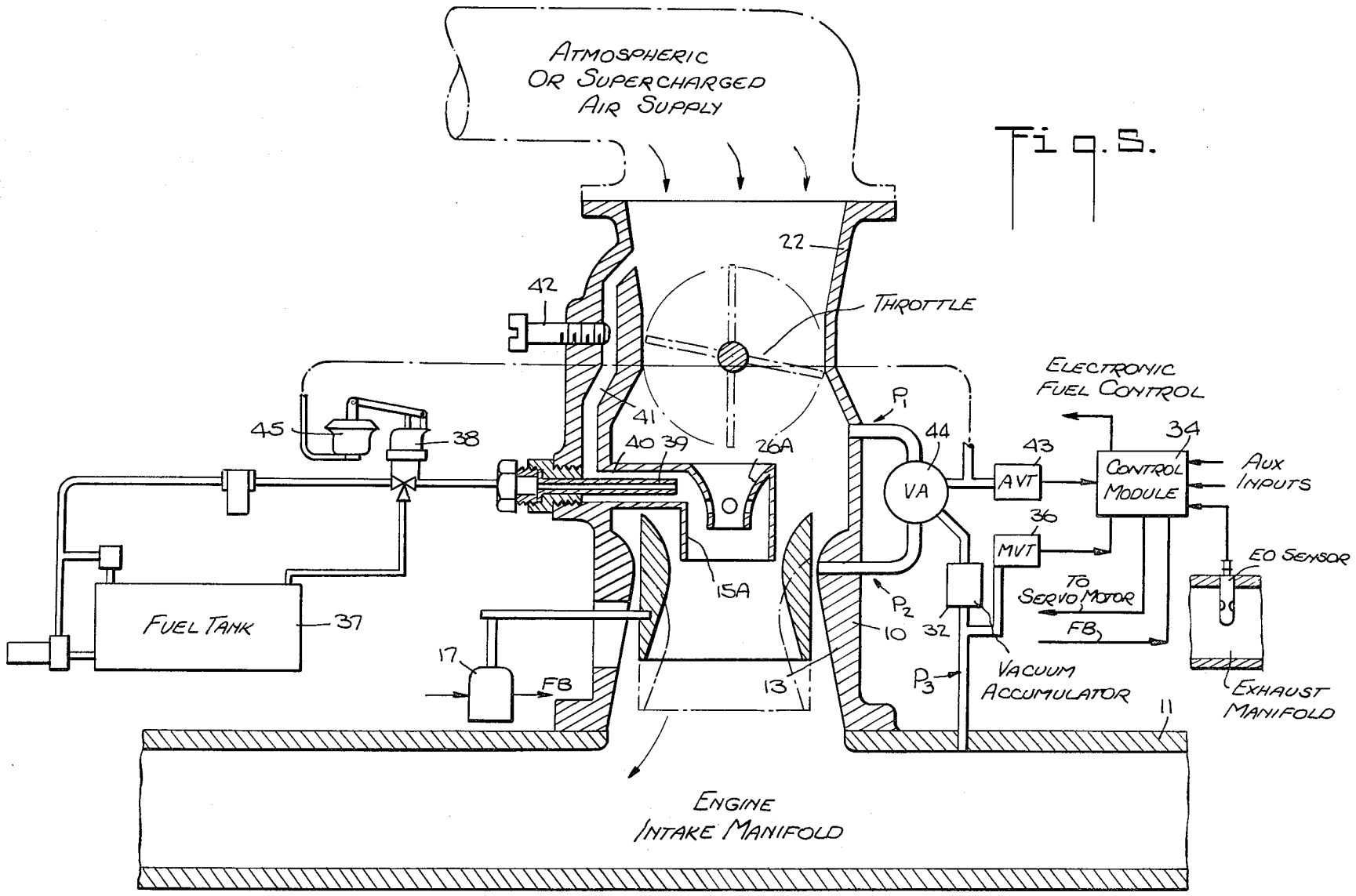
FIG. 5 illustrates a second embodiment of a variable Venturi system in accordance with the invention, using pressure fuel feed.

In this embodiment as shown in FIGS. 5 and 6, the Venturi structure is essentially the same as in FIG. 1A; but in this instance a fuel pressure feed is employed in which fuel from a tank 37 is pumped through a pressure regulated flow control valve 38 into a fuel jet tube 39 coaxially disposed in an air chamber 40. This chamber communicates through a duct 41 to the air inlet of the Venturi structure which duct acts as an air induction tube to produce a fuel spray or dispersion.

Chamber 40 has an aperture which feeds the resultant air-fuel spray into nozzle 26A seated within booster 15A of the Venturi structure. Thus the fuel dispersion is drawn into the Venturi primary passage as a result of both induction and pressure forces. Duct 41 is provided with an idle bypass screw 42.

In this arrangement, the electronic control system is essentially identical to that in FIG. 1, except that it contains an additional signal conditioning circuit for the air velocity sensor-transducer 43 which responds to differential pressure $P_1$–$P_2$ through vacuum amplifier 44 to regulate fuel pressure in a manner directly proportional to the magnitude of $P_1$–$P_2$.

However, since the fuel control is generated by vacuum amplification of $P_1$–$P_2$, the amplified value is also applied directly to vacuum motor 45 to modulate fuel pressure in direct proportion to the amplified $P_1$–$P_2$ vacuum. In this arrangement, the air intake may be an atmospheric air supply or a supercharged atmosphere obtained from known air blower arrangements for this purpose.

Thus all of the interacting and interrelated variables involved in the behavior of the internal combustion engine are taken into account, the sensed variables acting on the automatic control system to automatically regulate the ratio of air-to-fuel throughout the full spectrum of prevailing conditions of speed and load encountered under both ordinary and extraordinary conditions to optimize combustion efficiency.

Third Embodiment

It is well established that in an internal combustion engine, optimum combustion efficiency resulting in maximum engine power with minimum emission of unburned fuel and pollutants is attainable only when the proportion of fuel to air is at or closely approaches the stoichiometric ratio. For gasoline, this is 14.7 parts of air to one part fuel.

In the embodiment of the invention illustrated in FIG. 8, use is made of a solid-state sensor of the type presently marketed by "Autolite" and others, which is responsive to a gaseous constituent in the exhaust of an engine to yield an electrical output which varies as a function of the prevailing fuel-air ratio.

Figure 7:
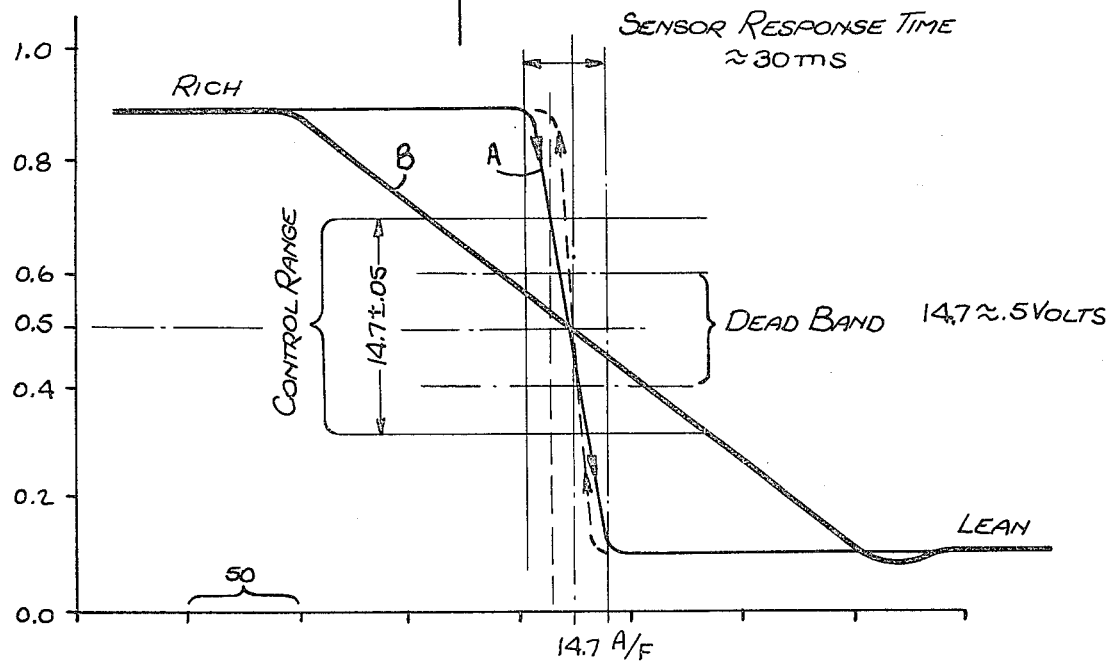
FIG. 7 is the curve of the air-fuel ratio sensor.

The response curve of an "Autolite" sensor is shown by curve A in FIG. 7 in which the output voltage of the sensor on a scale of 0.0 to 1.0 volts is plotted against time in a scale graduated in 50 millisecond intervals. The sensor output is such that at the 14.7 to 1 stoichiometric ratio, the sensor output is 0.5 volts. When the ratio of air-to-fuel deviates from the stoichiometric value as a result of a richer mixture, there is a proportional rise in voltage above 0.5 volts until a constant high level is reached; whereas when the ratio deviates from this value as a result of a leaner mixture, there is a proportional drop in voltage until a constant low level is reached. The slight displacement between the upward and downward voltage paths in curve A is due to hysteresis effects.

The sensor response time which defines the period between the upper and lower levels is about 30 milliseconds, as a consequence of which the response curve is very steep. Since this response time is too fast for the control system associated therewith to follow, it becomes necessary in the present invention to expand this response time so that, as indicated by curve B, the rise and fall of voltage with reference to the 0.5 volt input representing the stoichiometric ratio is extended in time and is therefore less steep. In the present invention, the control range is $\pm 0.05$ volts of the 0.5 volt level representing the stoichiometric ratio. The deadband which lies within the control range is about $\pm 0.025$ volts.

Referring now to FIG. 8 which illustrates a system in accordance with the invention that operates in conjunction with an air-fuel sensor 48 located in the engine exhaust, block 34 represents an electronic control module. This module is responsive to a manifold-vacuum (MVT) transducer 36 producing an auxiliary signal as a function of the manifold vacuum and to transducer 33 yielding a command signal as a function of air velocity.

Module 34 includes a summing differential amplifier 49 that at its non-inverting input receives the command signal from (AVT) transducer 33 that is proportional to the Venturi structure differential pressure $P_1-P_2$. This is summed in summing device 50 with a feedback signal FB derived from transducer 35 operatively coupled to servo motor 17. This motor acts, as explained in connection with FIG. 1, to adjust the throat of the variable Venturi structure to cause amplifier 49 to provide an input signal to a pair of comparators $C_1$ and $C_2$ which reflects this adjustment. These comparators act through a drive circuit 51 to govern servo motor 17 to open or close the variable Venturi to a null position between the output signal of amplifier 49 and feedback signal FB.

The command signal from transducer 33 which represents air velocity is applied to the non-inverting input of amplifier 49, whereas the auxiliary signal from transducer 36 which represents manifold vacuum is applied to the inverting input of this amplifier. This auxiliary signal is a function of throttle position, engine speed and load and acts by way of amplifier 49 to modulate the command signal, as required by the foregoing conditions. Such modulation of the command signal either holds the Venturi from opening or actually closes the Venturi to enrich the mixture; i.e., to decrease the air-fuel ratio by the increase of $P_1-P_2$. either for increased fuel by induction or by pressure feed. In FIG. 8, the symbol SP represents a set point source.

The predetermined or programmed characteristics of the command and auxiliary signals from transducers 36 and 33 therefore govern the air-fuel ratio in accordance therewith. The system in FIG. 8 as described up to this point is essentially the same as that disclosed in connection with FIG. 1. We shall now consider the changes dictated by the existence of the air-fuel ratio sensor 48 and the advantages gained thereby.

Differential amplifier 49 not only receives command and auxiliary signals, but is also capable of accepting other variables representing changing engine conditions that can be sensed and translated into corresponding analog voltages. These voltages may be used to modify the adjustment of the air-fuel ratio accordingly.

Differential amplifier 49 not only receives command and auxiliary signals, but is also capable of accepting other variables representing changing engine conditions that can be sensed and translated into corresponding analog voltages. These voltages may be used to modify the adjusting of the air-fuel ratio accordingly.

Thus one can add a voltage to the inverting input of amplifier 49 to decrease the air-fuel ratio for enrichment of the mixture, or one can add a voltage to the non-inverting input for increasing the ratio, thereby leaning the mixture. For example, temperature sensor 47 in the engine generates a voltage which is applied to the inverting input of amplifier 49 to effect enrichment of the mixture when the engine is cold.

In order to control the air-fuel ratio under all driving conditions and thereby, in effect, fine tune the control system so that regardless of prevailing engine and driving conditions, the fuel-air ratio is at all times held close to its stoichiometric value, use is made of air-fuel ratio sensor 48 whose output voltage is applied to an amplifier 52. This amplifier includes an appropriate R-C network to condition the response time of the air-fuel ratio signal which follows curve A in FIG. 7 so that the output of the amplifier assumes the form of curve B.

The output of amplifier 52 is fed to a pair of current differencing amplifiers 53 and 54 that compare this output with separate reference voltages developed across resistors 55 and 56 in a voltage divider. These reference voltages serve to set the deadband limits as defined in FIG. 7.

In this arrangement, amplifier 53 yields a signal proportional to the deviation from the lean mixture set point to enrich the mixture by adding this signal to the inverting input of amplifier 49. Conversely, amplifier 54 provides a voltage signal proportional to the deviation from the rich mixture set point to lean out the mixture by adding this signal to the non-inverting input of amplifier 49.

Thus a sensed change in air-fuel ratio from approximately 14.65 to 14.75, as represented in curve B by a 0.05 volt swing above or below the 0.5 volt stoichiometric ratio level, results in appropriate enrichment or leaning signals which act on the axially-shiftable spool 16 (FIG. 1) of the variable Venturi structure to restore the desired ratio. In this way, the air-fuel ratio is continuously corrected to maintain the optimum ratio under all conditions experienced in driving.

While there have been shown and described preferred embodiments of a fuel-air ratio automatic control system using variable Venturi structure in accordance with the invention, it will be appreciated that many changes and modifications may be made therein without, however, departing from the essential spirit thereof.

Thus the nature of the transducers for generating the various signals need not be of the type shown, but may be in any mechanical, electro-mechanical, electronic, pneumatic, fluidic or other configurations capable of producing a signal as a function of the variable being sensed. It is also to be understood that the optimum or optimized fuel-air ratio as this term is used herein is not necessarily meant the stoichiometric ratio, but that ratio which is optimum for a given vehicular engine under varying operating conditions.

I claim:

1. An automatic control system for supplying a fuel-air mixture to the intake manifold of the internal combustion engine of a vehicle for regulating the ratio of air to fuel so that this ratio is optimized for prevailing conditions of engine speed and load, said system comprising:

A. a variable Venturi structure whose inlet is coupled to a source of incoming combustion air and whose outlet is coupled to said intake manifold, said structure including concentric passages constituted by a primary Venturi passage having a throat and leading to a secondary Venturi passage having a variable area throat, and a tertiary Venturi passage having a throat, incoming air flowing through an inlet into all three passages to said intake manifold, and a mechanism for adjusting said variable area throat;

B. a servo motor operatively coupled to said mechanism to adjust said variable throat area;

C. means to supply fuel into said primary passage to intermingle with the air passing therethrough to produce an air-fuel mixture;

D. means communicating with said inlet and the throat of the tertiary passage to sense the pressure difference between that of the air at the inlet and that at the tertiary passage throat to produce a command signal that depends on the velocity of air flow through the Venturi structure; and E. a controller responsive to said command signal to govern said servo motor to adjust the area of the variable area throat and thereby change said air velocity so as to bring about the desired ratio of air and fuel in said mixture.

2. A system as set forth in claim 1, wherein said primary passage is defined by a cylindrical booster whose interior surface has a Venturi formation and said secondary passage is defined by an axially-shiftable spool whose interior surface has a Venturi formation, the variable area throat being formed between the interior surface of the spool and the exterior surface of the booster.

3. A system as set forth in claim 2, wherein said tertiary passage is formed by a ring having a Venturi formation mounted on a cylindrical casing surrounding said spool and said booster.

4. A system as set forth in claim 3, wherein said spool is provided at diametrically opposed positions with ribs which slide in channels formed in said ring.

5. A system as set forth in claim 4, wherein one of said ribs is provided with a pin projecting through said casing, in a slot therein, said pin being driven by said servo motor.

6. A system as set forth in claim 2, wherein said fuel is drawn from a chamber having a vertical fuel tube therein whose lower end is provided with a jet opening, the upper end of the tube being coupled by a duct to a nozzle disposed in said booster and having openings therein which spray the fuel into the booster.

7. A system as set forth in claim 6, wherein said duct feeds said fuel tangentially into the nozzle to create a vortex therein.

8. A system as set forth in claim 6, further including an air tube disposed within the fuel tube, the lower end of the air tube being immersed in the fuel in the tube, the upper end of the air tube communicating with the inlet to the Venturi structure whereby air is induced by said air tube into the fuel to disperse the fuel before it is conducted into the nozzle.

9. A system as set forth in claim 6, wherein said nozzle has an open horn formation and openings in the throat thereof, and is seated within the booster.

10. A system as set forth in claim 6, further including an air input throttle disposed in the inlet of the Venturi structure.

11. A system as set forth in claim 2, wherein said fuel is pumped from a tank through a fuel pressure regulator into a fuel injector which sprays the fuel into an air passage communicating with the primary Venturi passage.

12. A system as set forth in claim 11, further including means to operate said fuel regulator as a function of said pressure difference.

13. A system as set forth in claim 1, wherein said controller is an electronic control module and said command signal is produced by a transducer which converts said pressure difference into a corresponding electrical value that is applied to said module.

14. A system as set forth in claim 13, wherein also applied to said electronic module is an auxiliary signal which is derived by a transducer from the intake manifold pressure, said auxiliary signal modulating the command signal to effect control as a function of changing engine conditions as reflected by said manifold pressure.

15. A system as set forth in claim 14, wherein said module includes a differential amplifier having a non-inverting input and an inverting input whose output acts to govern said servo motor, said auxiliary signal being applied to said inverting input and said command signal to said non-inverting input.

16. A system as set forth in claim 15, further including a sensor positioned in the exhaust of said engine to provide a sensor signal that depends on the air-fuel ratio of the mixture, and means to apply said sensor signal to said differential amplifier in a manner maintaining said ratio at a value approaching the stoichiometric ratio of the mixture.

17. A system as set forth in claim 16, wherein said last-named means includes a pair of amplifiers, each comparing the sensor signal with a separate reference voltage to provide in one amplifier an enrichment signal representing the deviation in one direction of the sensor signal from the stoichiometric ratio, and in the other amplifier a leaning signal representing the deviation in the other direction, said enrichment signal being applied to said non-inverting input and said leaning signal being applied to the inverting input of the differential amplifier.

* * * * *

UNITED STATES PATENT OFFICE

CERTIFICATE OF CORRECTION

Patent No. 4,250,856 Dated FEBRUARY 17, 1981

Inventor(s) HAROLD G. ABBEY

It is certified that error appears in the above-identified patent and that said Letters Patent are hereby corrected as shown below:

In the Abstract, line 9, "IN" should read -- IS ---

COLUMN 3, LINE 30 CHANGE "AIR THROUGH" TO -- FUEL INTO --

COLUMN 4, LINE 17 CHANGE "AIR" TO -- FUEL --

COLUMN 5, LINE 27 CHANGE "AIR" TO -- FUEL --

COLUMN 5, LINE 55 DELETE "A PORTION OF"

COLUMN 5, LINE 57 AFTER "AND" INSERT -- A PORTION OF --

Column 6, line 27 "completion" should read -- combustion --

Column 8, line 26, "is" should read -- in --.

Signed and Sealed this

*Eighteenth* Day of *August 1981*

[SEAL]

*Attest:*

GERALD J. MOSSINGHOFF

*Attesting Officer*

*Commissioner of Patents and Trademarks*